US010584691B2

(12) United States Patent
McIntyre et al.

(10) Patent No.: US 10,584,691 B2
(45) Date of Patent: Mar. 10, 2020

(54) FLUID WORKING MACHINE AND METHOD OF OPERATING A FLUID WORKING MACHINE

(71) Applicant: Artemis Intelligent Power Limited, Midlothian (GB)

(72) Inventors: Fergus McIntyre, Midlothian (GB); Stephen Laird, Midlothian (GB)

(73) Assignee: ARTEMIS INTELLIGENT POWER LIMITED, Loanhead (GB)

( * ) Notice: Subject to any disclaimer, the term of this patent is extended or adjusted under 35 U.S.C. 154(b) by 567 days.

(21) Appl. No.: 15/217,330

(22) Filed: Jul. 22, 2016

(65) Prior Publication Data

US 2017/0022986 A1 Jan. 26, 2017

(30) Foreign Application Priority Data

Jul. 24, 2015 (EP) ..... 15178361

(51) Int. Cl.

| | |
|---|---|
| ***F04B 7/00*** | (2006.01) |
| ***F04B 49/22*** | (2006.01) |
| ***F04B 51/00*** | (2006.01) |
| ***F04B 49/03*** | (2006.01) |
| ***F04B 49/06*** | (2006.01) |
| ***F04B 53/10*** | (2006.01) |

(52) U.S. Cl.

CPC ..... *F04B 7/0076* (2013.01); *F04B 49/03* (2013.01); *F04B 49/065* (2013.01); *F04B 49/22* (2013.01); *F04B 51/00* (2013.01); *F04B 53/10* (2013.01); *F04B 53/1082* (2013.01)

(58) Field of Classification Search

CPC ..... F04B 7/0076; F04B 49/22; F04B 49/065; F04B 51/00; F04B 49/03

See application file for complete search history.

(56) References Cited

U.S. PATENT DOCUMENTS

| | | | | |
|---|---|---|---|---|
| 6,155,654 | A | 12/2000 | Oyama | |
| 6,276,340 | B1 | 8/2001 | Kato | |
| 7,762,221 | B2 | 7/2010 | Kira | |
| 9,010,104 | B2 * | 4/2015 | Rampen | F04B 49/22 60/459 |
| 9,091,253 | B2 * | 7/2015 | Stein | F01B 15/06 |

(Continued)

FOREIGN PATENT DOCUMENTS

| | | | |
|---|---|---|---|
| DE | 4009560 | A1 | 9/1991 |
| EP | 2851585 | A1 | 3/2015 |

(Continued)

*Primary Examiner* — Peter J Bertheaud

(74) *Attorney, Agent, or Firm* — Hauptman Ham, LLP

(57) ABSTRACT

A fluid working machine of the type comprising working chambers of cyclically varying volume and low and high pressure valves to regulate the flow of working fluid into and out of the working chamber, from low and high pressure manifolds, in which the valves are electronically controlled on each cycle of working chamber volume, by way of valve actuation signals, to determine the net displacement of working chambers. Additional valve actuator signals are generated in response to determination that a valve or working chamber has been inactive to adapt the valve to operate more reliably when subsequently actuated, but without significantly altering the net displacement of working chambers.

20 Claims, 8 Drawing Sheets

(56) References Cited

U.S. PATENT DOCUMENTS

| | | | | |
|---|---|---|---|---|
| 9,797,252 | B2 * | 10/2017 | Stein | F04B 39/10 |
| 9,797,393 | B2 * | 10/2017 | Rampen | F04B 49/22 |
| 9,828,986 | B2 * | 11/2017 | Caldwell | F04B 49/22 |
| 9,976,641 | B2 * | 5/2018 | Caldwell | F03D 7/0296 |
| 2002/0011241 | A1 | 1/2002 | Cook et al. | |
| 2010/0243067 | A1 | 9/2010 | Stein et al. | |
| 2011/0315004 | A1 | 12/2011 | Caldwell et al. | |
| 2012/0023918 | A1 | 2/2012 | Laird et al. | |
| 2012/0059524 | A1 | 3/2012 | Caldwell et al. | |
| 2013/0213212 | A1 | 8/2013 | Stein et al. | |
| 2015/0168958 | A1 | 6/2015 | Downie et al. | |
| 2016/0169222 | A1 | 6/2016 | Stein et al. | |
| 2016/0208898 | A1 | 7/2016 | Caldwell et al. | |

FOREIGN PATENT DOCUMENTS

| | | | |
|---|---|---|---|
| GB | 2378489 | A | 2/2003 |
| GB | 2459520 | A | 10/2009 |
| GB | 2477999 | A | 8/2011 |
| WO | 2011/104545 | A2 | 9/2011 |
| WO | 2013/118181 | A1 | 8/2013 |
| WO | 2015/040360 | A1 | 3/2015 |

* cited by examiner

PRIOR ART

PRIOR ART

FLUID WORKING MACHINE AND METHOD OF OPERATING A FLUID WORKING MACHINE

FIELD OF THE INVENTION

The invention relates to the field of fluid working machines in which the displacement of each working chamber is selectable on each cycle of working chamber volume by the active control of low pressure valves.

BACKGROUND TO THE INVENTION

It is known in the art to provide fluid working machines in which the flow of working fluid into and out of working chambers of cyclically varying volume (e.g. piston cylinder arrangement) is selected on each cycle of working chamber volume by actively controlling the opening or closing of at least one electronically controlled valve, to select the net displacement of working fluid by the working chamber on each cycle of working chamber volume.

This is known, for example, from EP 0361927 (Salter and Rampen) in which a low pressure valve (LPV) which regulates the flow of working fluid between a working chamber and a low pressure manifold is actively controlled to enable a pump to carry out either an active cycle or an inactive cycle. EP 0494236 (Salter and Rampen) developed this concept and introduced an actively controlled high pressure valve (HPV) which regulates the flow of working fluid between a working chamber and a high pressure manifold, enabling a motor to carry out either an active cycle or an inactive cycle and also enabling a fluid working machine to carry out either pumping or motoring cycles.

By active cycles we refer to cycles of working chamber volume which lead to a net displacement of working fluid from the low pressure manifold to the high pressure manifold, or vice versa. By inactive cycles, we refer to cycles of working chamber volume in which there is no net displacement of working fluid between the low and high pressure manifolds. Inactive cycles such as those described in EP 0361927 and EP 0494236 involve a working chamber receiving working fluid from the low pressure manifold and venting the same amount of working fluid back to the low pressure manifold, so that there is no net displacement of working fluid, although it is also known (e.g. from WO 2007/088380, Stein and Caldwell) to carry out an inactive cycle by keeping a working chamber sealed throughout a cycle of working chamber volume, from one minimum of working chamber volume until the next, so that there is no flow to or from any manifold.

In machines of this type, the LPV is actively controlled to select between active and inactive cycles, and in some embodiments to control the fraction of maximum stroke volume which is displaced during active cycles. In order to enable active control, each LPV is electronically controlled and has an, actuator, typically a solenoid, which is coupled to a valve member. A solenoid may for example act on an armature which is coupled to the valve member (without necessarily being rigidly connected) through a valve stem. The HPV is also typically actively controlled in which case it also has an electronically controlled actuator, typically a solenoid, which is coupled to a valve member. However, in the case of a pump, the HPV can be operated in a solely passive way, for example, it may be a normally closed, pressure openable check valve.

By active control we include the possibility of a valve being actively opened, actively closed, actively held open or actively held closed. A valve may be biased open (normally open) or closed (normally closed). An actively controlled valve may also move passively in some circumstances. For example, a LPV may be actively closed but open passively when the pressure in a cylinder drops below the pressure in the low pressure manifold.

In order to control the net displacement of a working chamber, one or more actuation signals are sent to the valve actuators of the respective LPV (and for motoring also the HPV). The actuation signals are selected so that the resulting displacement of the working chambers closely follows a target. The target displacement may change rapidly and as displacement decisions are made frequently, the actual displacement of the machine can vary very rapidly. Hence this type of machine can rapidly vary displacement and shaft torque, while operating in an energy efficient way. Examples of algorithms which can be employed to select active and inactive cycles to meet a target demand in this type of machine are, for example, disclosed in WO 2015/040360 (Caldwell et al.) and WO 2011/104549 (Rampen and Laird).

The efficiency of these machines requires careful control of the timing of valve opening and closing and so the function of the machines can be degraded if valve timing is not reliable. However, with this type of machine, we have identified that problems can arise if a valve is not used for a sufficient period of time. A valve which has not moved for a sufficient period of time may fail to move when it is commanded to do so, or may respond more slowly, or less predictably, than when the valve is being regularly used.

We have found that delays and irregularities in valve member movement can arise from a number of factors. Without wanting to be bound by theory, problems arising from a period of inactivity include:

1. A variation with time in the amount of damping arising from a squeeze film at the axial interface(s) of a valve member (particularly the LPV). A primary interface is the broadly axial face presented by the sealing line of the LPV on its corresponding valve seat. During a period of inactivity, the LPV valve member is thought to drift from a lightly seated position towards a more firmly seated position, pushing out oil from between the valve member and valve seat, thereby decreasing the thickness of the oil film leading to an increase in damping. In turn, this provides a greater resistance to unseating of the valve member.

2. The thickness of the oil film around the valve member also affects the transition from boundary to dynamic fluid lubrication to hydrodynamic lubrication. When there is a prolonged period of no valve movement, boundary lubrication acts between the LPV and primarily the bore, and may involve metal to metal contact. As the valve member starts to move, working fluid is drawn into the intermediate space, a dynamic fluid wedge/hydrodynamic filed is created and the lubrication mode switches instead to dynamic fluid/hydrodynamic. The damping forces are in part influenced by this transition which is itself influenced by the thickness of the oil film.

3. Inactivity may also lead to concentricity drift, possibly arising due to tilting of the low pressure valve. The longer that the LPV remains stationary, the more likely it is for the valve member or other parts connected to the valve member (e.g. armature or valve stem) to suffer from movement to one side of the bore within which they travel, leading to a thicker oil film on one side and thinner oil film on the other. The variation in film thickness will likely increase the overall damping force on the travelling member.

4. Another factor may be stick-slip, which is the relaxation-oscillation phenomena involving the build-up of elastic energy as a tangential force is applied. The tangential force increases until it exceeds the interfacial resisting force, at which point instant slip occurs. The LPV suffers primarily a single stick event per stroke, and the stick-slip process repeats only when LPV returns to a seated position and is again demanded to open.

5. If a solenoid valve actuator is used less frequently, it will be cooler than if it is regularly used, meaning that it will have a lower electrical resistance therefore higher efficiency and greater current when actuated.

6. Magnetic materials may be influenced by remanence or remanent magnetization. The magnetic flux circuit established when a solenoid is energized may remain magnetized after the current is removed.

7. After actuation of a solenoid, eddy currents may remain circulating for a period of time. Eddy currents will therefore persist between frequent actuations of a solenoid controlled valve but will die away after a period of inactivity. After a greater period of inactivity, the energy required to fully re-establish the magnetic circuit in a solenoid increases.

Many of the above effects which have a detrimental effect on valve performance are closely time related, and thus their influence typically peaks at machine start up (when the machine has been dormant for long period of time).

Hence, when a valve actuation signal is sent to the actuator of a valve which has been inactive for a sufficient period of time, the amount of fluid displaced by the respective working chamber may be more or less than required, or the required tolerance in valve response time may cause the valve timings to have to be set suboptimally to avoid a risk of failure.

Accordingly, the invention seeks to address problems arising from unreliable valve actuation arising from periods of inactivity of a valve. This will enable the resulting machine to be more stable, more reliable, more efficient and/or more tolerant of variations in environmental factors (e.g. temperature).

Note that although a given valve will have been inactive before start up of the machine it is in the nature of these machines, which make decisions as to displacement on cycle by cycle basis, that individual working chambers and their valves may remain inactive for a period of time even if the machine is operating continuously with non-zero displacement being met by other working chambers carrying out active cycles.

SUMMARY OF THE INVENTION

According to a first aspect of the invention there is provided a method of operating a fluid working machine, the machine comprising a rotatable shaft and a plurality of working chambers having working volumes which vary cyclically with rotation of the rotatable shaft, each working chamber having a low pressure valve which regulates the flow of working fluid between the working chamber and a low pressure manifold and a high pressure valve which regulates the flow of working fluid between the working chamber and a high pressure manifold, each low pressure valve being an electronically controlled valve having a valve actuator, the method comprising transmitting primary actuation signals to actuate the actuators, in phased relationship to cycles of working chamber volume, to thereby actively control the said electronically controlled valves and so determine the net displacement of each working chamber on each cycle of working chamber volume, and selecting the net displacement of a group of one or more of the working chambers to follow a target, and further determining whether a valve inactivity test is met in respect of a said low pressure valve of a said working chamber and, responsive to said determination, transmitting one or more additional actuator signals to the actuator of the respective low pressure valve, which additional actuator signals do not significantly change the net displacement of working fluid by the respective working chamber Correspondingly, as there is no significant change in the net displacement (relative to the net displacement determined by the primary actuation signals) of the working chamber, there will be no significant change in the torque exerted on the rotatable shaft (relative to the torque arising from the net displacement determined by the primary actuation signals).

The machine can therefore continue to operate so that the displacement of the group of one or more working chambers follows the target, as a result of the response of the electronically controlled valves to the primary actuation signals, but the controller can still transmit additional actuator signals to valve actuators without significantly affecting net displacement. The additional actuator signals may, for example, not cause either the low or high pressure valve to open or close and therefore not affect the net displacement of working fluid by the respective working chamber (the working chamber having the low pressure valve in respect of which the valve inactivity test is met). The additional actuator signals may, for example, cause a valve (the respective low and/or high pressure valve) to open and/or close but at times which do not significantly change the net displacement of working fluid by the respective working chamber which would have occurred had only the primary actuation signals been transmitted. The additional actuator signals adapt the valves or their valve actuators to mitigate an effect of inactivity, without significantly affecting the net displacement of the respective working chamber. The mitigated effect of inactivity may be a deleterious effect although it is a higher priority that the valve subsequently behaves reliably when used frequently. Hence, the additional actuator signals may adapt the valves or their valve actuators to enable them to respond to primary actuation signals (to follow the target displacement) more like they do when frequently actuated (e.g. actuated every cycle of working chamber volume), without significantly affecting the net displacement of the respective working chamber.

It may be that at least some, or all, of the high pressure valves are also electronically controlled valves having a valve actuator and the transmitting primary actuation signals to said valve actuators to actively control the said electronically controlled valves may comprise transmitting primary actuation signals to the valve actuators of the high pressure valves. The high pressure valves are actively controlled in this way during motoring cycles but it is not essential for them to be actively controlled during pumping cycles and in a machine which is a pump and not operable as a motor, the high pressure valves may be passively actuated, for example they may be check valves.

Typically the valve inactivity test will be met by a said low pressure valve of a respective working chamber and one or more additional actuator signals are transmitted to the actuator of said low pressure valve (in respect of which the valve inactivity test is met). Optionally, if the high pressure valves are electronically controlled valves having valve actuators, one or more said additional actuator signals may also be sent to the actuator of the high pressure valve of the respective working chamber. The additional actuator signals may be transmitted, in the case of an integrated valve where a single primary actuation signal may actuate both valves, to a single actuator urging both the low and high pressure valves of the respective working chamber. (The respective working chamber is the working chamber having the low pressure valve which meets the valve inactivity test.)

We also disclose that a said valve inactivity test may be met by a said high pressure valve of a respective working chamber and one or more additional actuator signals be transmitted to the actuator of the low pressure valve of the respective working chamber.

Preferably, the additional actuator signals lead to a change in the net displacement, of the respective working chamber, during the same cycle of working chamber volume, of less than 2% of the maximum displaceable volume (the "stroke volume" in the case of a piston cylinder arrangement) of the working chamber (relative to the net displacement which would have occurred without the additional actuator signals). Ideally, the additional actuator signal does not lead directly (i.e. in the same cycle that the additional signal or signals are provided) to a change in the net displacement. By the same cycle, we refer to the period of time from when a working chamber is at bottom dead centre (a maximum of working chamber volume), through top dead centre (a minimum of working chamber volume), to the next bottom dead centre (a maximum of working chamber volume).

The primary actuation signals, and the additional actuator signals may be transmitted by a controller, which typically comprises a processor executing a program stored on a solid state computer readable medium in electronic communication with the said processor. However, the controller may be implemented in whole or in part as electronic circuits. The controller may select the net displacement of the group of one or more of the working chambers to match a target. The target may be received through a target input and processed by the controller. The controller may calculate the target. The target may be calculated from a received demand signal, which is indicative of a required value of a parameter which is related to the net displacement of the group of one or more of the working chambers, for example a torque demand signal (which is proportional to both the net displacement and the pressure). The target is typically a target for the combined net displacement of the plurality of working chambers which make up the said group. The machine may have one or more further working chambers and may select the net displacement of a plurality of different groups of working chambers to each match a separate target. Working chambers may be reallocated from one group to another during operation. This is useful to enable the machine to service a plurality of separate sources or sinks of working fluid to meet a plurality of different working functions at the same time.

The primary actuation signals, and additional actuator signals, are typically electrical signals conducted by a conductor, such as a wire (for example, a track on a circuit board). The primary actuation signals, and additional actuator signals, may cause the respective actuator to urge the respective valve member, either to open or close, for example to cause an open valve to close, or to cause an open valve to remain open, or to cause a closed valve to open, or to cause a closed valve to remain closed. A primary actuation signal, or additional actuator signal may provide a force on a valve member which causes it to remain open when it would otherwise close or to remain closed when it would otherwise open. A primary actuation signal, or additional actuator signal, may cause the actuator to stop providing a force on a valve member which urges the valve to remain or open, or closed.

One skilled in the art will appreciate that a primary actuation signal or additional actuator signal can be communicated in any suitable form, for example as an analogue or digital voltage or current, which may be modulated, and that form may be changed between the controller and the actuators, for example modulated, demodulated, amplified, converted from digital to analogue etc. A primary actuation signal or an additional actuator signal may take the form of a change in the voltage of a conductor or the current through that conductor. A primary actuation signal or an additional actuator signal may comprise a change in the mean voltage or mean current through a conductor, for example that may change the mark to space ratio of discrete pulses of voltage or current through a conductor.

The primary actuation signals and additional actuator signals need not actually cause the respective valve member to move. Whether the valve member can move in response to a primary actuation signal or additional actuator signal will depend on factors such as the direction of any biasing (e.g. spring) acting on the valve member or the direction and magnitude of a pressure differential across the respective valve. Nevertheless in some embodiments, the additional actuator signals cause the respective valve member to move.

Where the actuators comprise solenoids, the primary actuation signals, and additional actuator signals may change the mean current passing through the solenoids (e.g. the may increase the mean current, or decrease the mean current). We refer to the mean current because the current need not be DC and may, for example, be a pulse width modulated signal. The actuators may comprise solenoids which act on a magnetic pole piece, which is typically slidably mounted, and which is coupled to a valve member and it may be that the primary actuation signals do not change the mean current passing through the solenoids sufficiently to cause the magnetic poles to move.

The valve inactivity test may be met if a respective low pressure valve is determined to be inactive.

The low pressure valves are each associated with respective working chambers, and the method comprises determining the net displacement of each working chamber on each cycle of working chamber volume, and so the valve inactivity test may be met in respective of a low pressure valve if a working chamber meets an inactivity test. If a working chamber is inactive (carrying out only inactive cycles) it can be inferred that the low pressure valve associated with the respective working chamber is inactive. Therefore, the step of determining whether the valve inactivity test is met in respect of a said low pressure valve may comprise determining with the respective low pressure valve, or the working chamber which has the respective low pressure valve, meet one or more inactivity criteria.

Hence the valve inactivity test may be carried out by, for example, processing records of either the activity of working chambers (examples of working chamber activity: numbers of pump strokes/motor strokes/idle strokes with simple breathing to/from low pressure manifold) or the activity of individual low pressure valves of those working chambers (i.e. the cyclic change in valve status, with working chamber cycle, between open and closed, or measuring the current transmitted to the actuators of individual low pressure valves).

Determining whether a valve inactivity test is met in respect of a said low pressure valve may comprise determining whether the respective working chamber has not undergone an active cycle, or has not undergone a certain type of cycle (e.g. a motoring cycle) or has only undergone inactive cycles (with no net displacement of working fluid) for a predetermined period of time, or for a predetermined number of cycles of working chamber volume. (In a motoring cycle the high pressure valve must be actively controlled but in a pumping cycle it is possible for the high pressure valve to be only passively controlled). A number of cycles of working chamber volume can be inferred from e.g. a number of rotations of the rotatable shaft, a number of executions of an algorithm which is executed when the rotatable shaft is at defined orientations etc.

Similarly, the method may comprise determining whether a respective low pressure valve has not been actuated for a predetermined period of time, or for a predetermined number of cycles of working chamber volume and, if so, considering the valve inactivity test to be met.

The valve inactivity test may comprise that the machine has received an instruction to start operating. The additional actuator signals may be transmitted in response to the start-up of the machine.

It may be that the transmission of said additional actuator signals takes places within one cycle of working chamber volume, or within two cycles of working chamber volume or within another predetermined number of cycles of working chamber volume immediately preceding the transmission of actuator signals to the respective valve actuator to select the net displacement of working chamber so that the net displacement of the group of working chambers follows the target.

It may be that the valve inactivity test is different for different valves, or working chambers, of groups of working chambers, or valves thereof (e.g. different groups of working chambers, each group being connected to a different source or sink of working fluid). For example, in response to determination that a respective low pressure valve has been taking longer than a threshold time to move in response to a primary actuation signal, said determination to send additional actuator signals to the respective electronically controlled valve may take place more frequently.

The valve inactivity test may be variable. For example, the period of time or number of inactive cycles of working chamber volume before additional actuator signals are transmitted to the actuator of a low pressure valve may be variable, for example, said period of time or number of inactive cycles may increase after a threshold period of inactivity of a valve or working chamber. This may reduce power consumption during longer periods of inactivity.

The valve inactivity test may comprise determination that the thickness of a fluid film adjacent a part of a respective valve meets a criterion. The thickness of a working fluid film, for example, that between a valve component and a cooperating surface, e.g. between a valve member and a valve seat, may depend on the duration of the contact between the parts, the force biasing the parts together (e.g. valve member biasing spring force), the surface area of the contact between the parts, and the viscosity of the working fluid. The valve inactivity test may depend on measured parameters, such as working fluid viscosity or a temperature measurement (which in itself affects the viscosity of the working fluid), or the measured thickness of a working fluid layer by a thickness sensor (e.g. an ultrasonic thickness sensor). Typically a valve inactivity test is time dependent—in particular taking into account the time since previous actuation of the respective low pressure valve.

Typically, the valve inactivity test is carried out while the fluid working machine is operating, the rotating shaft is rotating and at least some working chambers are carrying out active cycles in which they make a net displacement of working fluid. The valve inactivity test is typically met by only a subset of the working chambers at any given time. The valve inactivity test is typically met by a working chamber on fewer than 2% of cycles of working chamber volume, on average, while the machine is in operation.

It may be that the additional actuator signals do not lead to opening of the high pressure valve.

Accordingly, in such embodiments, the respective working chamber remains sealed from the high pressure manifold and so there is no net displacement by the respective working chamber. Thus, the additional actuator signals do not significantly change the net displacement of working fluid by the respective working chamber because the high pressure valve is closed and because the additional actuator signals do not cause the high pressure valve to open.

It may be that, responsive to said determination, the one or more additional actuator signals are transmitted to the actuator of the low pressure valve of the respective working chamber, to cause the respective low pressure valve to close and then to open again while the respective working chamber remains sealed from the high pressure manifold.

The reopening of the low pressure valve may be controlled at least in part by another additional actuator signal. However, it may be that an additional actuator signal causes the respective low pressure valve to close but it opens again passively, e.g. due to biasing by a spring or a change in the pressure differential across the valve member.

Thus, the high pressure valve associated with the respective working chamber remains closed while the said low pressure valve is closed and opened again. The respective low pressure valve is initially open. Typically, for one or more immediately preceding cycles of working chamber volume, the low pressure valve has been held open so that respective working chamber made no net displacement of working fluid (thus defining an inactive cycle because no working fluid was driven from the respective working chamber via the HPV).

Accordingly, although there may be a flow of working fluid to and from the low pressure manifold during the cycle, there is no net displacement of working fluid (i.e. no net flow of working fluid from the low pressure manifold to the high pressure manifold, or vice versa) by the respective working chamber as a result of the additional actuator signals. The net displacement of working fluid by the respective working chamber (if any) is the same as it would have been had the additional actuator signals not occurred. Typically, the said low pressure valve is closed and then opened again within a period of time which is less than 15% (54° of phase), less than 10% (36° of phase) or less than 5% (18° of phase) of the period of a cycle of working chamber volume. The period of a cycle of working chamber volume is inversely proportional to the speed of rotation of the rotatable shaft. The period of a cycle of working chamber volume may be determined by measuring the speed of rotation of the rotatable shaft.

It may be that the said low pressure valve is closed and then opened again during a single expansion stroke of the respective working chamber.

Accordingly, the fluid connection between the respective working chamber and the low pressure manifold is temporarily blocked. This may potentially cause the drawing of a vacuum within the working fluid. This takes place within a single expansion stroke and the same amount of working fluid will be received into the respective working chamber during the expansion stroke as would otherwise be the case.

This is because working fluid will enter the respective working chamber at differing rates to fill the volume of the expanding working chamber, and the fluid will flow at a greater rate if filling or replacing a vacuum drawn during the temporary blocking, and thus the volume of the expanding working chamber will be the same at the end of the expansion stroke irrespective of the temporary blocking of flow from the low pressure manifold.

It may be that the said low pressure valve is closed and then opened again within a period of time which is less than 25% of the period of a cycle of working chamber volume and the said opening again takes place before bottom dead centre (by which we refer to a maximum of working chamber volume).

It may be that the said low pressure valve is closed (seals the respective working chamber from the low pressure manifold) and then opened again (allows fluid to flow between the respective working chamber and the low pressure manifold again) at a phase within 75° of bottom dead centre (a maximum of working chamber volume). Preferably, the said low pressure valve is closed and then opened again within 20%, 10%, 5%, 2.5% or 1% (72°, 36°, 18°, 9°, 3.6° of phase) of the period of a cycle of working chamber volume before bottom dead centre.

Due to delays between the transmission of additional actuator signals and a valve closing, or opening as appropriate, the period of time between additional actuator signals to close and then open the valve may be greater. For example, there may be significant delays (perhaps 10-20% of the period (36-72° of phase) of a cycle of working chamber volume between an additional actuator signal to close the low pressure valve and the low pressure valve actually sealing the respective working chamber from the low pressure manifold. These delays can arise from the time required to build up current in the solenoid actuator, time required for the valve actuator and valve member to move etc.

Typically, the said electronically control valve is closed at a time which is with 25% (90° of phase), or 20% (72° of phase) of the period of a cycle of working chamber volume before bottom dead centre. Typically, the said electronically control valve is closed at a time which is at least 5% (18° of phase), or at least 10% (36° of phase) of the period of a cycle of working chamber volume before bottom dead centre.

If the low pressure valve remains closed overly near to bottom dead centre, this may cause an unintended pumping cycle, in which the low pressure valve is held closed by the pressure differential through a contraction stroke, leading to a net displacement of working fluid. Accordingly, typically, the said electronically control valve is opened again at a time which is at least 1% (3.6° of phase), at least 2% (7.2°), at least 3% (10.8°), at least 5% (18°) or at least 10% (36°) of the period of a cycle of working chamber volume before bottom dead centre.

Typically, the said electronically control valve is closed prior to the time within a cycle of working chamber volume at which the low pressure valve is closed during pumping cycles.

It may be that, responsive to said determination, the one or more said additional actuator signals are transmitted to the respective valve actuator to urge the low pressure valve open wherein no actuation signal to cause the actuator to urge the low pressure valve open has been transmitted to the respective valve actuator for a period of time which is at least the period of a cycle of working chamber volume.

It may be that, responsive to said determination, the one or more additional actuator signals are transmitted to the said actuator of a low pressure valve, to cause the respective valve to open and then to close again while the respective working chamber remains sealed from the high pressure manifold.

In this case, both the low pressure valve and the high pressure valve will initially have been closed and the respective working chamber will have remained sealed for one or more immediately preceding cycles of working chamber volume. In this case, the said low pressure valve typically opens within a period of time which is less than 5% or less than 2% of the period of a cycle of working chamber volume before top dead centre (by which we refer to a minimum of working chamber volume). Preferably the low pressure valve is next closed at or after top dead centre. This avoids making a net displacement of working fluid by pumping working fluid out through the HPV as the working chamber contracts.

It is known for a working chamber to carry out an inactive cycle, with no net displacement of working fluid, by holding the low pressure valve open for an entire cycle (starting from about bottom dead centre). Working fluid is received from the low pressure manifold during the expansion stroke and the same amount is vented back to the low pressure manifold during the subsequent contraction stroke. The high pressure valve remains closed. Accordingly, although there is flow into and out of the low pressure manifold, there is no net displacement of working fluid. This is discussed in EP 0361927 and is referred to as a sort of idle cycle in the art and is a typical mode in which both the high pressure valve and the low pressure remain inactive. It is also known for a working chamber to carry out an inactive cycle, with no net displacement of working fluid, by holding the low pressure valve closed for an entire cycle of working chamber volume (starting from about top dead centre). In that case, the working chamber expands, cavitation occurs as the pressure of retained working fluid drops, and the working chamber contracts again. Pressure remains low and so the high pressure valve also remains closed and the working chamber is sealed. Again, there is no net displacement of working fluid. This is referred to as an idle cavitation cycle and is again another possible mode in which both the low pressure valve and high pressure valve may remain inactive for a period of time.

It may be that at least one of the working chambers has made no net displacement of working fluid for one or more consecutive cycles, with the respective high pressure valve closed, and with the respective low pressure valve in either state (a) in which the low pressure valve remains open so that the respective working chamber remains in fluid communication with the low pressure manifold or state (b) in which the respective low pressure valve remains closed so that the respective working chamber remains sealed, and responsive to said determination, closing or opening the respective low pressure valve to swap from state (a) to state (b) or vice versa.

It may be that, responsive to said determination, while said the respective working chamber is contracting, the additional actuator signals are transmitted to the actuator of said low pressure valve associated with the respective working chamber, to cause the respective valve to move from an open position to a closed position to seal the respective working chamber and thereby cause the pressure in the respective working chamber to increase as the working chamber further contracts. The low pressure valve may close, for example, within 10% (36° of phase), 5% (18° of phase), 2.5% (9° of phase) or within 1.5% (6° of phase) of the period of a cycle or working chamber volume before top dead centre (minimum of working chamber volume).

It may be that the high pressure valve associated with the respective working chamber does not open as a result (i.e. the respective working chamber remains sealed from the high pressure manifold by the respective high pressure valve).

It may be that the high pressure valve associated with the respective working chamber is then at least partially opened.

The respective high pressure valve may open passively. This may occur because the force exerted on the high pressure valve due to the pressure difference between the respective working chamber and the high pressure manifold is sufficient to cause the valve to move, taking into account any biasing force.

It may be that, once the respective high pressure valve opens, pressurized working fluid from the respective working chamber passes out of the respective working chamber into the high pressure manifold, through the high pressure valve, while the respective working chamber contracts and then substantially the same amount of pressurized working fluid from the high pressure manifold passes into the respective working chamber from the high pressure manifold as the respective working chamber then expands.

Thus there is substantially no net displacement between the respective working chamber and the high pressure manifold, and therefore substantially no net displacement between the respective working chamber and the low pressure manifold. The extent to which the amount of working fluid entering and leaving the high pressure manifold can be matched depends on the accuracy of the control of valve timings. Typically the amount of pressurized working fluid which passes into the respective working chamber is less than 1% of the maximum displacement of the respective working chamber and is also less than 10% of the amount of working fluid which passes out of the respective working chamber into the high pressure manifold.

It may be that the additional actuator signals do not lead to the net displacement of working fluid because they do not cause the said valve to move but they temporarily adapt the actuator to function more quickly and/or more reliably in response to a subsequent actuation signal.

Said additional actuator signals may adapt the actuator by warming a part of the actuator, for example a solenoid. It may be that such warming causes the actuator to function more slowly, or providing reduced actuation force, but beneficially in a manner more consistent with the characteristics of frequently used actuators. Said additional actuator signals may adapt the actuator by varying (typically increasing) remanence or remanent magnetization within the actuator, for example within a magnetic circuit which forms part of the actuator. Said additional actuator signals may adapt the actuator by generating and/or maintaining eddy currents within the actuator.

The response of the actuator to one or more additional controls signals may also be checked to test the status of the actuator, for example to check that there is no short circuit or to check the resistance of the actuator (e.g. if the actuator is solenoid).

The method typically comprises receiving a phase signal indicative of the phase of cycles of working chamber volume and controlling the timing of the additional actuator signals relative to the phases of cycles of working chamber volume with reference to the phase signal.

Typically, the additional actuator signals are generated during one cycle, or two consecutive cycles of working chamber volume, and not during the subsequent cycle of volume (or preferably subsequent ten cycles of volume) of the same working chamber.

Preferably, the transmission of the additional actuator signals does not lead to a significant change in the net torque exerted on the rotatable shaft, for example no change in net torque which exceeds 5% of the maximum torque which the piston/cylinder can generate.

It may be that the low and/or high pressure valves are solenoid actuated face seating valves, e.g. poppet valve.

By the low pressure manifold and high pressure manifold we refer to the relative pressure of the manifolds. In a pump, the low pressure manifold is the manifold from which fluid is received and the high pressure manifold is the manifold to which fluid is pumped. In a motor, the high pressure manifold is the manifold from which pressurized fluid is received and the low pressure manifold is the manifold to which fluid is vented.

Typically, for all working chambers, additional actuator signals are not transmitted during at least some cycles of working chamber volume.

According to a second aspect of the invention there is provided a fluid working machine comprising a rotatable shaft and a plurality of working chambers having working volumes which vary cyclically with rotation of the rotatable shaft, each working chamber having a low pressure valve which regulates the flow of working fluid between the working chamber and a low pressure manifold and a high pressure valve which regulates the flow of working fluid between the working chamber and a high pressure manifold, each low pressure valve being an electronically controlled valve having a valve actuator, a controller configured (e.g. programmed) to transmit primary actuation signals to the actuators, to thereby actively control the said electronically controlled valves in phased relationship to cycles of working chamber volume and so determine the net displacement of each working chamber, and selecting the net displacement to match the net displacement of the working chambers to follow a target, and also to determine whether a valve inactivity test is met in respect of a said low pressure valve of a working chamber and, responsive to said determination, transmitting additional actuator signals, to the actuator of the said low pressure valve, which additional actuator signals do not significantly change the net displacement of working fluid by the respective working chamber.

The controller typically comprises at least one processor (and possibly multiple processors) and at least one solid state computer readable medium, in electronic communication with the at least one processor, storing computer program instructions. However, the controller may be implemented in whole or in part as electronic circuits. The function of the controller may be distributed amongst a plurality of processors. The controller may have a target input through which a target is received.

The controller may comprise a working chamber decision module which decides whether to cause individual working chambers to carry out active or inactive cycles in order to follow the target, an inactivity determination module which decides whether the controller should generate additional actuator signals, and a signal generation module in communication with both the working chamber decision module and the inactivity determination module which generates the actuation signals and additional actuator signals.

The fluid working machine may be a pump. The fluid working machine may be a motor. The fluid working machine may be a pump-motor which is operable as a pump or a motor in alternative operating modes. The fluid working machine may be pneumatic. The fluid working machine may be hydraulic.

The high pressure valves may also be electronically controlled valves having a valve actuator, and the controller may be configured to transmit primary actuation signals to the valve actuators of the high pressure valves.

The fluid working machine may comprise wires through which the primary actuation signals, and additional actuator signals, are conducted to the valve actuators. The fluid working machine may comprise actuator driver circuits, for example solenoid driver circuits, such as field effect transistors, which relay the primary actuation signals, and additional actuator signals, to the actuators, and change their form, for example, modulating, demodulating, amplifying or converting from digital to analogue, or from analogue to digital, the primary actuation signals, and additional actuator signals.

The actuators may comprise solenoids. The low pressure and/or high pressure valves may comprise a magnetic pole piece, which is typically slidably mounted, and which is coupled to a valve member. The fluid working machine may comprise solenoid driver circuits which switch the current provided to the solenoid of the low pressure valves and/or the high pressure valves with a mark to space ratio which varies responsive to the primary actuation signals and/or additional actuator signals.

The low pressure valves and/or the high pressure valves may comprise a valve member and a biasing member, such as a spring, which biases the valve member and/or the valve actuator, so that the valve is by default open or by default closed.

It may be that the additional actuator signals do not lead to opening of the high pressure valve.

It may be that, responsive to said determination, the one or more additional actuator signals are transmitted to the actuator of a said low pressure valve, to cause the respective low pressure valve to close and then to open again while the respective working chamber remains sealed from the high pressure manifold.

It may be that the said low pressure valve is closed and then opened again during a single expansion stroke of the respective working chamber.

It may be that the said low pressure valve is closed and then opened again within a period of time which is less than 25% of the period of a cycle of working chamber volume and the said opening again takes place before bottom dead centre (by which we refer to a maximum of working chamber volume).

It may be that, responsive to said determination, the one or more said additional actuator signals are transmitted to the respective valve actuator to urge the low pressure valve open wherein no actuation signal to cause the actuator to urge the low pressure valve open has been transmitted to the respective valve actuator for a period of time which is at least the period of a cycle of working chamber volume.

It may be that, responsive to said determination, the one or more additional actuator signals are transmitted to the said actuator of a low pressure valve, to cause the respective valve to open and then to close again while the respective working chamber remains sealed from the high pressure manifold.

It may be that, when at least one of the working chambers has made no net displacement of working fluid for one or more consecutive cycles, with the respective high pressure valve closed, and with the respective low pressure valve in either state (a) in which the low pressure valve remains open so that the respective working chamber remains in fluid communication with the low pressure manifold or state (b) in which the respective low pressure valve remains closed so that the respective working chamber remains sealed, and responsive to said determination, closing or opening the respective low pressure valve to swap from state (a) to state (b) or vice versa.

It may be that, responsive to said determination, while said the respective working chamber is contracting, the additional actuator signals are transmitted to the actuator of said low pressure valve associated with the respective working chamber, to cause the respective valve to move from an open position to a closed position to seal the working chamber and thereby cause the pressure in the respective working chamber to increase as the respective working chamber further contracts. It may be that the high pressure valve associated with the respective working chamber is then at least partially opened.

It may be that, once the respective high pressure valve opens, pressurized working fluid from the respective working chamber passes out of the respective working chamber into the high pressure manifold, through the high pressure valve, while the respective working chamber contracts and then substantially the same amount of pressurized working fluid from the high pressure manifold passes into the respective working chamber from the high pressure manifold as the working chamber then expands.

It may be that the additional actuator signals do not lead to the net displacement of working fluid because they do not cause the said valve to move but they temporarily adapt the actuator to function more quickly or more reliably in response to a later actuation signal.

The fluid working machine may comprise a phase sensor (such as a shaft encoder associated with the rotating shaft) which generates a signal indicative of the phase of cycles of working chamber volume. The controller may be configured to control the timing of the additional actuator signals relative to the phases of cycles of working chamber volume with reference to the phase signal.

Further optional features of the second aspect of the invention correspond to those discussed above in relation to the first aspect of the invention.

BRIEF DESCRIPTION OF THE DRAWINGS

An example embodiment of the invention will now be illustrated with reference to the following Figures.

DETAILED DESCRIPTION OF AN EXAMPLE EMBODIMENT

Figure 1:
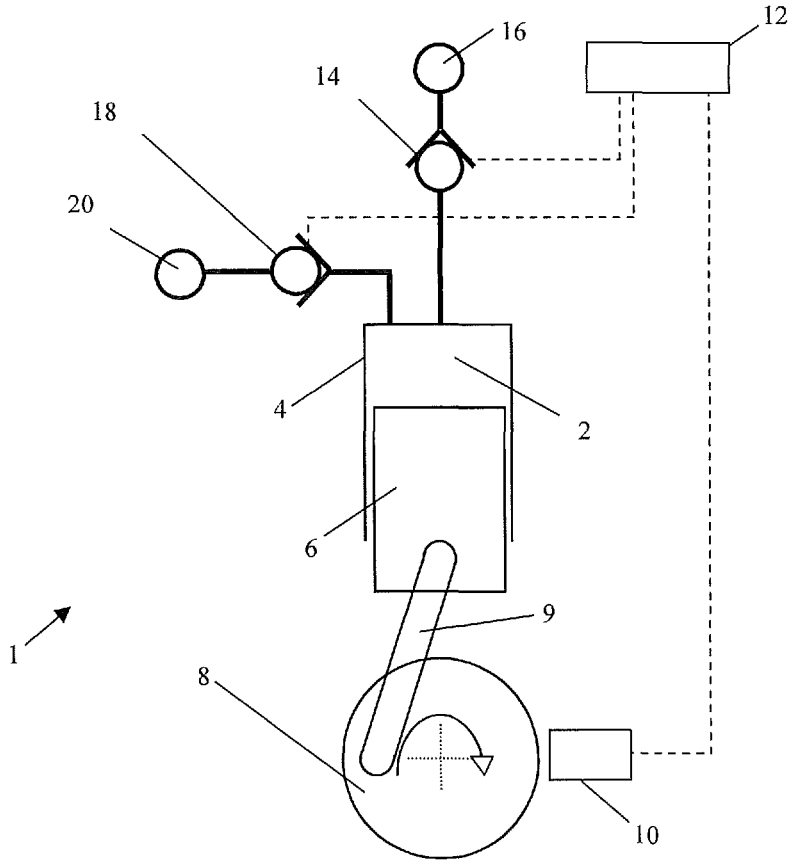
FIG. 1 is a schematic diagram of a prior art fluid working machine.

FIG. 1 is a schematic diagram of an individual working chamber 2 in a fluid-working machine 1, which typically comprises a plurality of corresponding working chambers. The fluid-working machine may be a pump, which carries out pumping cycles, or a motor which carries out motoring cycles, or a pump-motor which can operate as a pump or a motor in alternative operating modes and can thereby carry out pumping or motoring cycles. The net throughput of fluid is determined by the active control of electronically controllable valves, in phased relationship to cycles of working chamber volume, to regulate fluid communication between individual working chambers of the machine and fluid manifolds. Individual chambers are selectable by a controller, on a cycle by cycle basis, to either undergo an active cycle in which they displace a predetermined fixed volume of fluid or to undergo an inactive cycle with no net displacement of fluid, thereby enabling the net throughput of the machine to be matched dynamically to a demand.

An individual working chamber 2 has a volume defined by the interior surface of a cylinder 4 and a piston 6, which is driven from a crankshaft 8 by a crank mechanism 9 and which reciprocates within the cylinder to cyclically vary the volume of the working chamber. A shaft position and speed sensor 10 determines the instantaneous angular position and speed of rotation of the shaft, and transmits shaft position and speed signals to a controller 12, which enables the controller to determine the instantaneous phase of the cycles of each individual working chamber. The controller typically comprises a microprocessor or microcontroller which executes a stored program in use.

The working chamber comprises an actively controlled low pressure valve in the form of an electronically controllable face-sealing poppet valve 14, which faces inwards toward the working chamber and is operable to selectively seal off a channel extending from the working chamber to a low pressure manifold 16. The working chamber further comprises a high pressure valve 18. The high pressure valve faces outwards from the working chamber and is operable to seal off a channel extending from the working chamber to a high pressure manifold 20.

Figure 2:
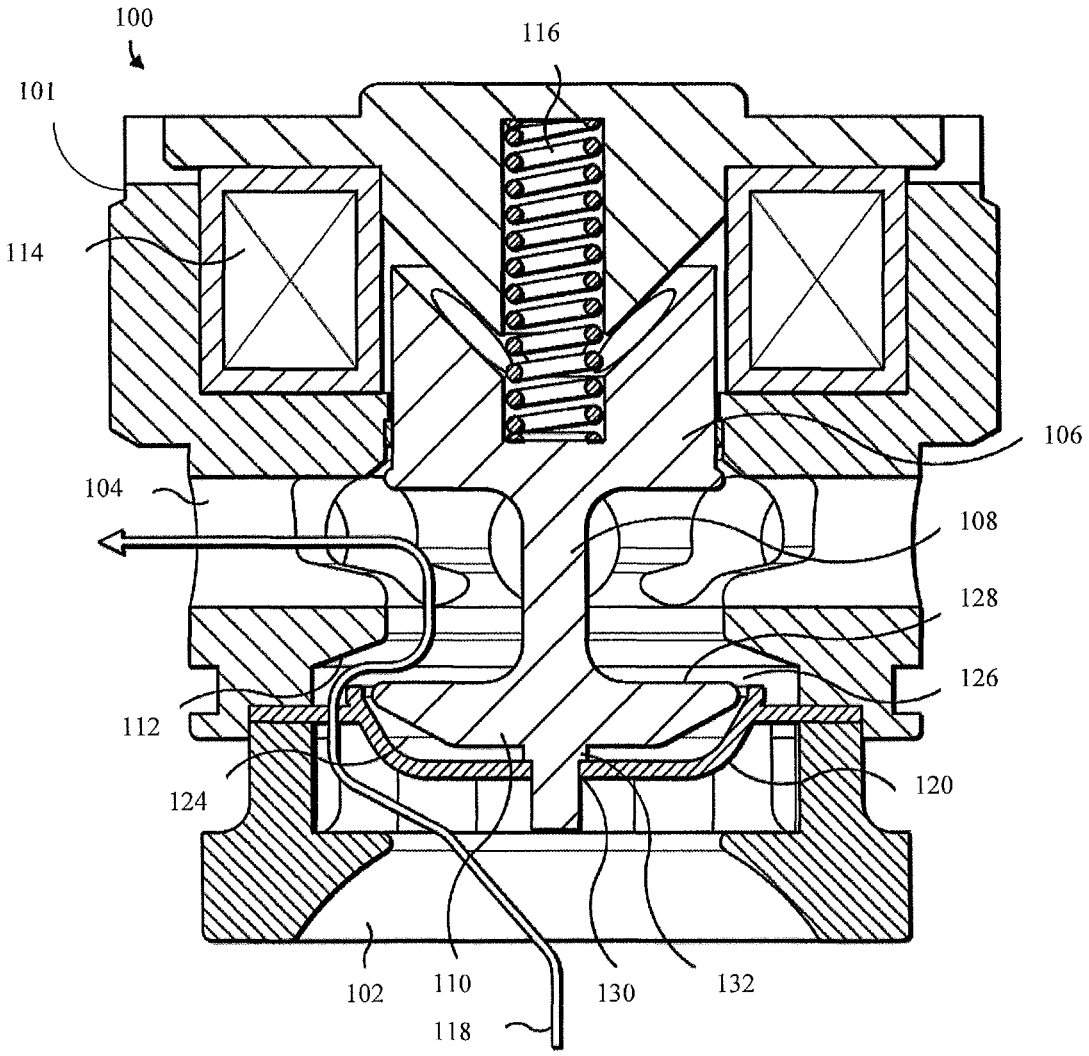
FIG. 2 is a cross section through an electronically controlled LPV.

An example LPV 100 is shown in cross section in FIG. 2. The LPV has a valve body 101, a first port 102 in communication with a working chamber and a second port 104 which leads to the high pressure manifold through a plurality of radially extending apertures. If the machine is a pump, the first port is the inlet and the second port is the outlet and the net flow out of the working chamber is by path 118. In a motor, the first port is the outlet and the second port is the inlet and the flow of fluid is reversed. In a machine operable as either a pump or a motor the first and second ports can function as inlet or outlets depending on the direction of fluid flow.

The valve includes an armature 106 which is formed integrally with a valve stem 108 which connects the armature to a poppet valve head 110, functioning as the valve member. The armature and solenoid are part of a magnetic circuit conducted through the valve body. The poppet valve head is operable between the open position illustrated in FIG. 2 and a closed position in which is seals against a valve seat 112.

A solenoid 114 can be used to close the valve under the active control of the controller and a return spring 116 is provided to bias the armature away from the electromagnet and therefore bias the poppet valve head to the open position. The solenoid and armature together function as the actuator. A barrier 120 on the working chamber side of the valve head, away from the valve seat, fixed to the valve assembly by radial connecting arms 122 between which fluid can flow. The barrier defines a chamber 124 which communicates with a constricted flow region 126 around the periphery of the valve member. When fluid flows out through the valve assembly, along the flow path 118, the pressure drops in the constricted flow region and therefore also in the reduced pressure chamber providing an opening force which counteracts forces on the poppet valve arising from the flow of working fluid along path 118. The valve stem extends beyond the poppet valve head, through an aperture 130 in the barrier and includes a flange 132 which cooperates with the periphery of the aperture to limit movement of the poppet valve head away from the valve seat so that there is always at least some fluid in the chamber between the barrier and the poppet valve head. This reduces the formation of squeeze film at this location which would provide additional resistance to closing, increasing the power consumption of the valve assembly and reducing the operating speed.

The HPV may be an electronically controlled valve with a solenoid acting on an armature coupled to a valve member, generally corresponding to the LPV, although for a dedicated pump it may be a simply spring loaded check valve, for example.

In the LPV shown, the armature, valve stem and valve member function as a travelling member which moves backwards and forwards to open and close the valve. Oil films form between the travelling member and the body of the valve, for example at the valve sealing line, but also between the armature and the body. In some embodiments, the travelling member comprises two or more parts which do not always move together, for example, the armature may bear on the valve stem to close the valve but able to move away from the valve stem under the control of the actuator, with the valve stem and valve member biased towards the armature by a spring.

Figure 3:
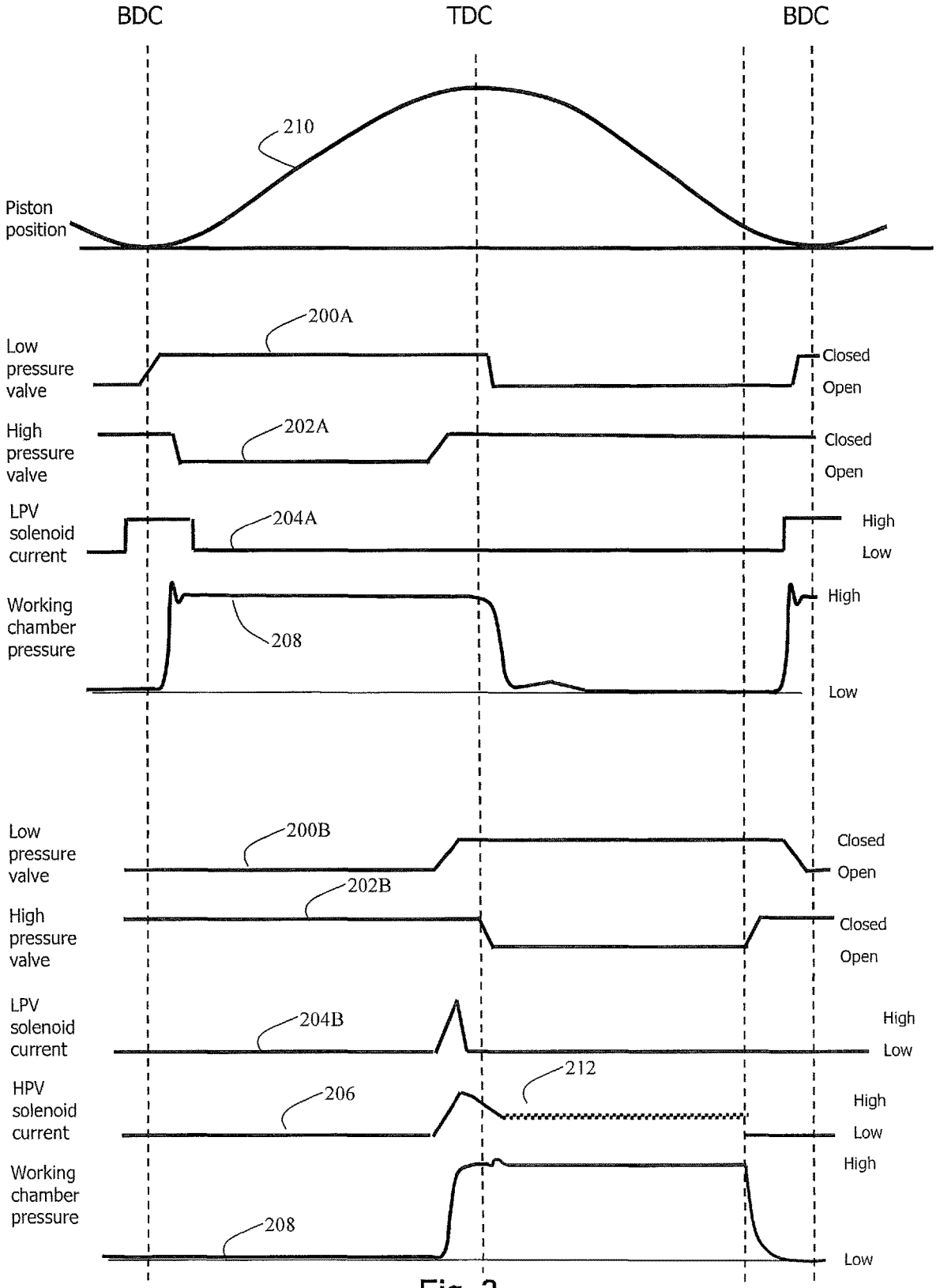
FIG. 3 is a schematic diagram of LPV position, HPV position, working chamber pressure and solenoid actuation signals for both pumping (upper traces) and motoring (lower traces) in prior art fluid working machines.

FIG. 3 shows the details of a full stroke active pumping cycle (top) and motor cycle (bottom).

The figure shows the variation within time in LPV position 200A, HPV position 202A, LPV solenoid current 204A and working chamber pressure 208A (which is illustrated relative to the low pressure manifold pressure) during a pumping cycle, as well as the variation in LPV position 200B, HPV position 202B, the LPV solenoid current 204B, HPV solenoid current 206 and working chamber pressure 208B during a motoring cycle. The timing of events is shown relative to cycles of working chamber volume 210 between the point of maximum volume, bottom dead centre (BDC) and point of minimum volume, top dead centre (TDC).

A pumping cycle begins with the LPV and HPV closed. Shortly before BDC a current is passed through the LPV solenoid, as shown in the upper part of FIG. 3. As a result, a closing force is applied to the LPV valve member. The force exerted on the armature exceeds the biasing force from the LPV spring and the LPV opens. Pressure in the working chamber rises as the working chamber contracts whilst sealed and the HPV opens passively once the pressure differential between the working chamber and the high pressure manifold is sufficiently low that the net force urging the high pressure valve open exceeds the forces urging the HPV closed arising from the pressure differential across the HPV valve member. Working fluid is then displaced from the working chamber into the high pressure manifold.

The HPV closes passively when the piston reaches TDC and the working chamber begins to expand again. The LPV then opens during the expansion stroke once the pressure within the working chamber is sufficiently close to the low pressure manifold that the spring biasing the low pressure valve can overcome the force due to the pressure differential across the LPV valve member. During the subsequent expansion stoke, the LPV remains open and hydraulic fluid is received from the low pressure manifold.

At or around BDC, the controller determines whether or not the LPV should be closed. If so, fluid within the working chamber is pressurized and pumped to the HPV during the subsequent contraction phase of working chamber volume, as before. However, if the LPV remains open, fluid within the working chamber is vented back to the low pressure manifold and an inactive cycle occurs, in which there is no net displacement of fluid to the high pressure manifold. In an inactive cycle, the low and high pressure valves will both remain inactive; the high pressure valve will remain closed and the low pressure valve will remain open (although it is also known to carry out in inactive cycle in which the low pressure valve remains closed).

In some embodiments, the LPV will be biased open and will need to be actively closed by the controller if a pumping cycle is selected. In other embodiments, the LPV will be biased closed and will need to be actively held open by the controller if an idle cycle is selected. The HPV may be actively controlled, for example an actuation signal may be used to provide additional force to urge it open or closed, although for the pumping cycle described above it is sufficient for the HPV to be a check valve.

With reference to the lower part of FIG. 3, in order to carry out a motoring cycle, both the LPV and HPV are actively controlled. During a contraction stroke, fluid is vented to the low pressure manifold through the low pressure valve. The low pressure valve is closed before top dead centre, causing pressure to build up within the working chamber as it continues to reduce in volume. Once sufficient pressure has been built up, a current is applied to the HPV solenoid so that the HPV opens, and fluid flows into the working chamber from the high pressure manifold. Once the HPV is open, the energy required to keep it open may be reduced and the mean current is reduced 212 using pulse width modulation. Shortly before bottom dead centre, the HPV is actively closed, whereupon pressure within the working chamber falls, enabling the low pressure valve to open around or shortly after bottom dead centre.

In some embodiments, the low pressure valve will be biased open and will need to be actively closed by the controller. In other embodiments, the low pressure valve will be biased closed and will need to be actively held open by the controller if an inactive cycle is selected. The low pressure valve typically opens passively, but it may open under active control to enable the timing of opening to be carefully controlled. Thus, the low pressure valve may be actively opened, or, if it has been actively held open this active holding open may be stopped. The high pressure valve may be actively or passively opened.

In some embodiments, instead of selecting only between idle cycles and full stroke pumping and/or motoring cycles, the fluid-working controller is also operable to vary the precise phasing of valve timings to create partial stroke pumping and/or partial stroke motoring cycles. In a partial stroke pumping cycle, the low pressure valve is closed later in the exhaust stroke so that only a part of the maximum stroke volume of the working chamber is displaced into the high pressure manifold. Typically, closure of the low pressure valve is delayed until just before top dead centre. In a partial stroke motoring cycle, the high pressure valve is closed and the low pressure valve opened part way through the expansion stroke so that the volume of fluid received from the high pressure manifold and thus the net displacement of fluid is less than would otherwise be possible.

Figure 4:
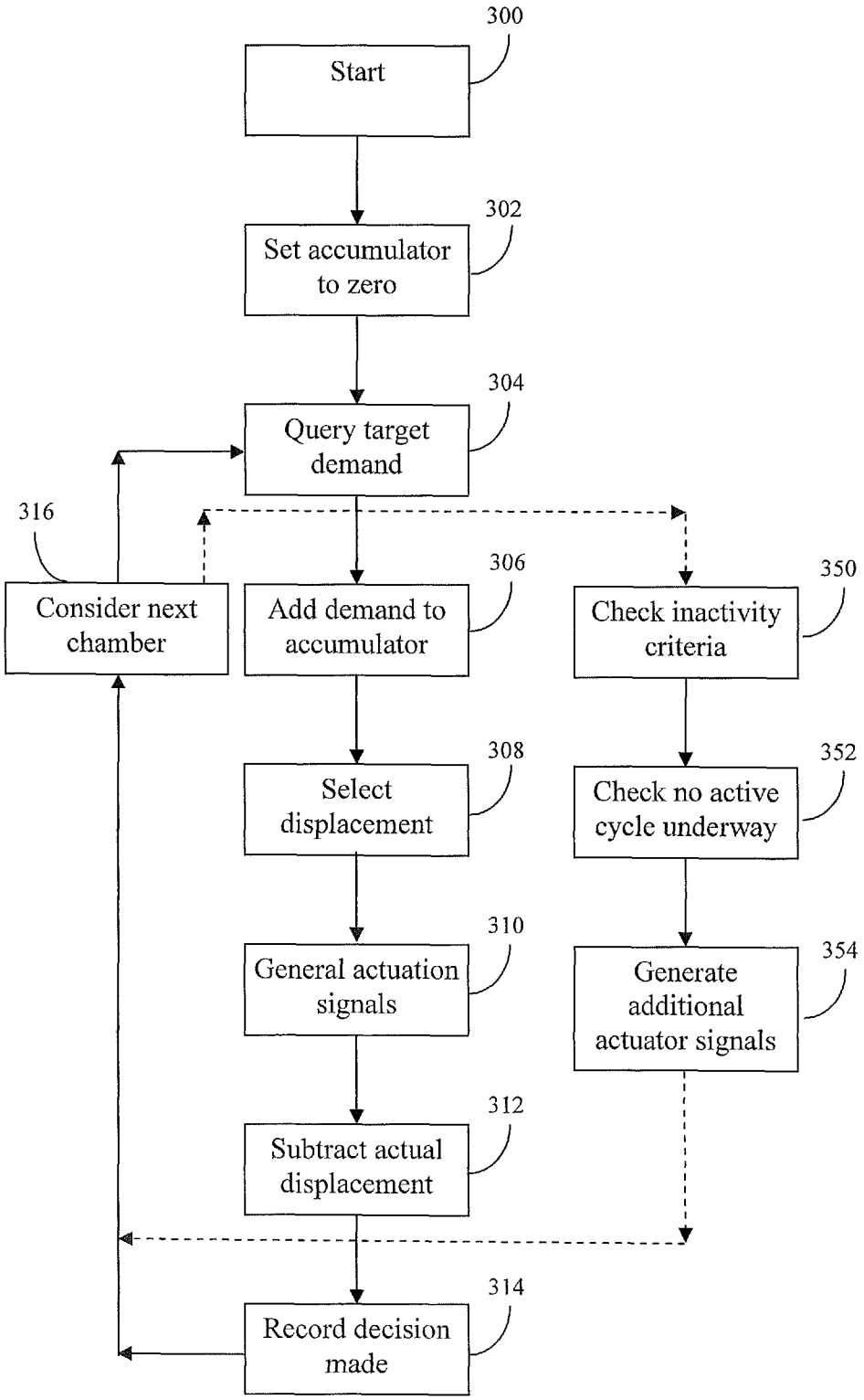
FIG. 4 is a flow chart of the procedure carried out by the controller to generate actuation signals.

FIG. 4 sets out the procedure carried out by the fluid working machine controller to generate actuation signals. The procedure starts 300 and a register storing an accumulator is set to zero 302. As the rotatable shaft turns, each time it reaches a position where a displacement decisions should be made for a working chamber, it queries a received target demand signal 304 and then adds the received demand, expressed in consistent units, to the accumulator. A higher positive value indicates a higher amount of as yet unmet demand for displacement. The value of the accumulator is then used to select the displacement of the working chamber selected 308. In a known implementation, the working chamber will be caused to carry out an active cycle in which it displaces the maximum possible displacement if the accumulator is greater than half (for example) of the displacement of an individual working chamber. Other decision making algorithms are known to the person skilled in the art, for example in WO 2015/040360 (Caldwell et al.) or WO 2011/104549 (Rampen and Laird). The decision are made so that the total displacement follows that indicated by the target displacement, although actual displacement and target displacement need not perfectly match, for example, to avoid broken cylinders or the generation of unwanted frequencies. The controller then generates actuation signals 310 to actively control the LPV of the respective working chamber (and the HPV if required) at the correct times within the cycle of working chamber volume to generate an active or inactive cycle as required, as shown in FIG. 3. The actuation signals are typically transmitted to a switching circuit which switches current to the respective solenoid on or off in response, for example using a FET. The accumulator is then updated 312 by subtracting the amount of displacement carried out by the working chamber. Accordingly, the accumulator continues to monitor the displacement which has been demand but not as yet met. The decision as to the displacement made by the working chamber is then recorded 314. The algorithm then repeats, considering the next working chamber in turn 316.

This procedure generates actuation signals to cause the net displacement of the working chambers to follow a target demand. That is the aim is to establish a fluid input or output from the machine that accurately matches the target demand. In parallel, the controller also repetitively tests 350 whether a valve inactivity test is met for each working chamber in turn. In one embodiment, this valve inactivity test is met if the working chamber has not been instructed to carry out an active cycle (with a net displacement of working fluid) for a number of cycles exceeding a threshold period of time, as determined from the recorded data concerning past displacement decisions. The data concerning past displacement decisions could be as simple as a register which is incremented on each cycle that a respective working chamber carried out an inactive cycle and is set to zero each time that the respective working chamber carries out an active cycle. In another embodiment, the valve inactivity test is met if the working chamber has not carried out an active cycle for a threshold period of time, again determined from the recorded data concerning past displacement decisions. In this case, it is necessary to store when a working chamber was last used or to store data concerning the time variation of the speed of rotation of the rotatable shaft, which determines the instantaneous frequency of cycles of working chamber volume.

Figure 5:
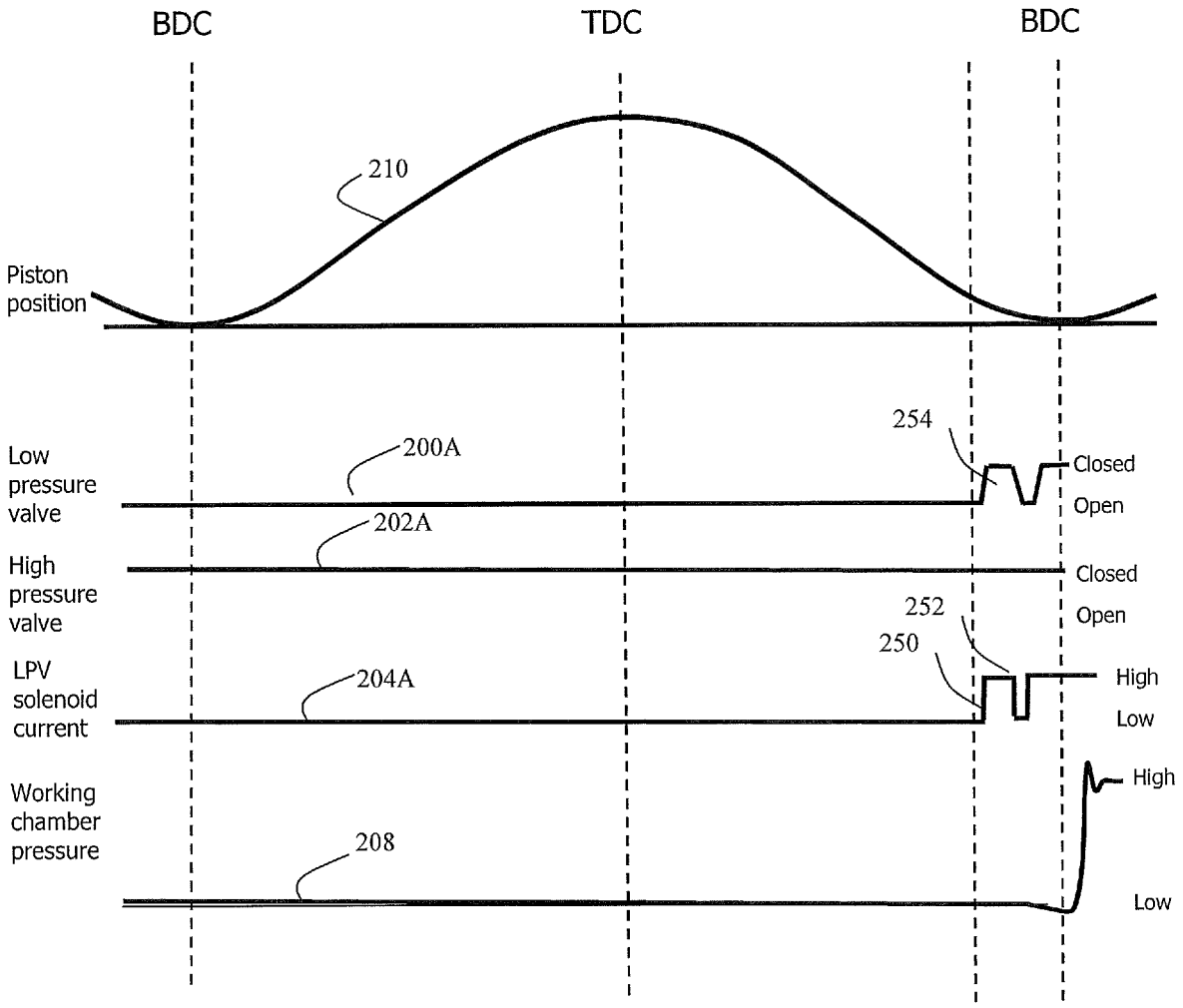
FIG. 5 is a schematic diagram of LPV position, HPV position, working chamber pressure and LPV solenoid current in a cycle in which the LPV moves but there is no net displacement of working fluid.

If the controller determines 350 that the valve inactivity test is met for a working chamber, and if an active cycle is not already underway 352 it then generates additional actuator signals 254, timed relative to cycles of working chamber volume, as shown in FIG. 5. The additional actuator signals generate an increase in LPV solenoid current 250 just before bottom dead centre to close the LPV for a brief period of time 254 until the LPV is commanded to open again shortly thereafter. The increase in LPV current is a first additional actuator signal 250 and the decrease in LPV current 252 is a second additional actuator signal. The current changes required to open and close the LPV depend on the nature of the LPV. For example, if the LPV was biased closed instead of biased open, the first additional actuator signal would be current flow stopping and the second additional actuator signal would be current flow restarting.

This extra actuation of the LPV, closing and opening again, has no effect on net displacement by the working chamber. The flow of working fluid from the low pressure manifold into the working chamber is simply briefly interrupted when the LPV closes and once it opens again, additional fluid flows in to fill the volume of the working chamber. The pressure in the working chamber remains low and the HPV does not open.

The additional actuator signals 250, 252 and the closure and subsequent opening of the LPV 254 are best carried out at around, and ideally just before, bottom dead centre. The LPV should be reopened before the normal LPV closing time during an active pumping cycle, at least if there is any possibility that an active pumping cycle will immediately follow this extra actuation. It would be less energy efficient for the extra actuation of the LPV to take place close to a mid-stroke position, half way between TDC and BDC, when the rate of fluid flow is the highest, as this would put excessive forces on the LPV.

This extra transmission of actuator signals to the LPV has several beneficial effects. Firstly, it may disturb the working fluid film around the valve member, returning the fluid film to a thickness which is desirable and likely to remain consistent during ongoing frequent actuation of the valve. Hence, the valve will have more consistent and fast response during subsequent actuations. Accordingly, the fluid film has been adapted. Secondly, the coils of the LPV solenoid will be heated up by the current flow, and so achieve a temperature which will be more consistent with that maintained during a regular actuation. Accordingly, the solenoid has been adapted. The valve member, valve stem and armature may also be aligned more centrally and or axially. Accordingly, the configuration of the valve member, valve stem and armature has been adapted. Finally, there can be beneficial magnetic effects. The armature, and other magnetic materials which form the magnetic circuit between the solenoid and the armature in use, will result in build-up of remanence or remanent magnetization as well. Accordingly, the magnetic circuit is adapted temporarily to maintain characteristics which it will have during normal operation with frequent actuation of the LPV.

Accordingly, any additional actuation of the LPV arising from the additional actuator signals has adapted the LPV so as to cause it to respond to subsequent actuations in a manner consistent with its response during normal operation, with frequent actuation. This adaptation is temporary and will be lost over time if the valve again becomes inactive.

Note that some of these benefits will be obtained even if the magnitude of the LPV current is not sufficient to cause the LPV to fully open, perhaps sufficient only to temporarily unseat the LPV member, and perhaps not move the LPV member at all. However, in some embodiments it may be important for the LPV to fully open.

Figure 6:
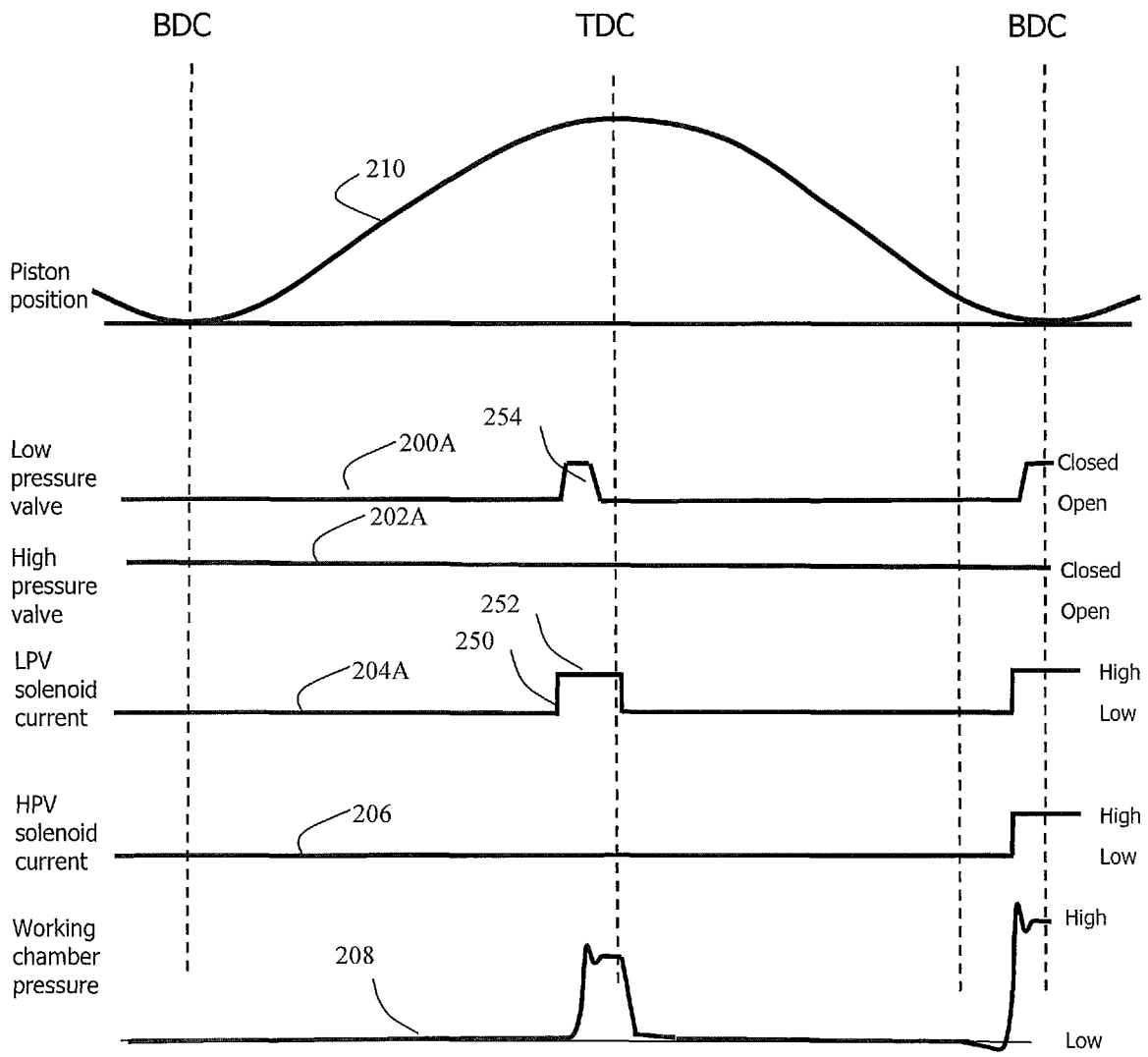
FIG. 6 is a schematic diagram of LPV position, HPV position, working chamber pressure and solenoid currents in an alternative cycle in which the LPV moves but no fluid is displaced to the high pressure manifold.

FIG. 6 illustrates an alternative timing for additional actuator signals to the LPV. In this example, the current to the LPV solenoid is increased to close the LPV and decreased to allow the LPV to open, just before top dead centre. Again, the increase in current to close the LPV and the subsequent decrease in current to allow the LPV to open are first and second additional actuator signals. The pressure in the working chamber increases during this time (because the working chamber is temporarily sealed from both the high pressure and low pressure manifolds, while it continues to contract) but the pressure does not reach the pressure required to open the HPV and vent fluid to the high pressure manifold. Hence, this extra actuation of the LPV again has the effect of moving the LPV valve member, obtaining the benefits set out above, but without leading to a net displacement of working fluid.

Figure 7:
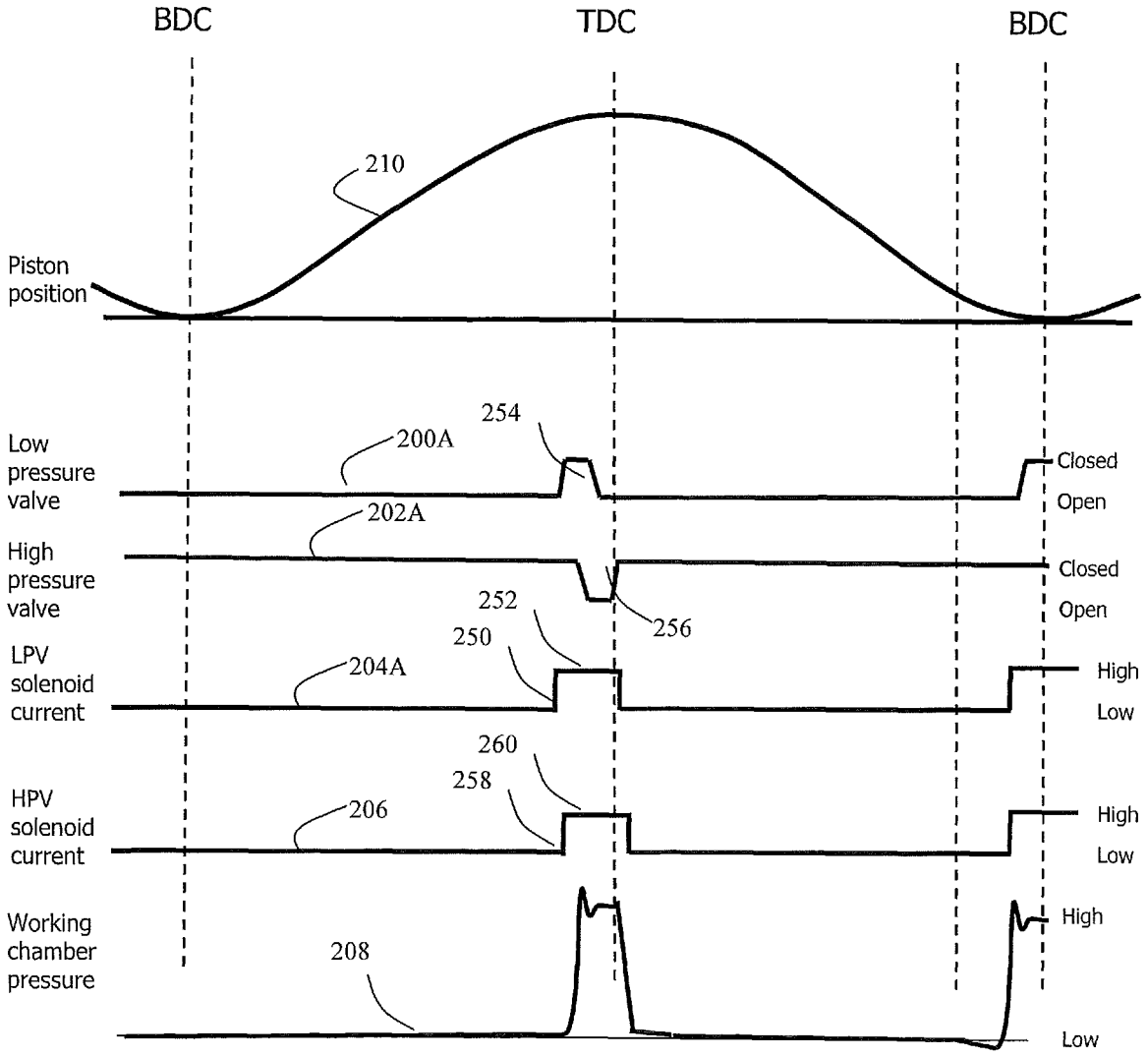
FIG. 7 is a schematic diagram of LPV position, HPV position, working chamber pressure and solenoid currents in a cycle in which the LPV and HPV moves but there is no net displacement of working fluid.

With reference to FIG. 7, if the LPV is closed for a sufficiently long period of time, sufficiently far before TDC, the pressure in the working chamber will increase to the pressure required to move the HPV valve member, leading to the HPV opening 256 briefly. The pressure required to cause movement will typically be around the high pressure manifold pressure but will depend on the direction and magnitude of spring biasing forces on the HPV valve member and whether there is a current in the HPV solenoid. It may be that the HPV valve member is moved only sufficiently to unseat it and not sufficiently to move it from the closed position to entirely open and it may be that the HPV is not moved sufficiently to allow fluid to pass. However, if the LPV closure timing is brought forward and/or the duration of LPV closure is increased, the HPV will open fully.

In order to ensure some movement of the HPV, additional actuator signals 258, 260 may be generated to cause current to be start being passed through the HPV solenoid and then to stop being passed through the HPV solenoid. However, in some embodiments this may be optional as the HPV may anyway open due to the pressure differential across the HPV valve member.

Opening of the HPV while the working chamber is contracting has the effect that working fluid will be pumped from the working chamber to the high pressure manifold. In order to avoid substantial net displacement, the HPV is kept open until after top dead centre so that as the working chamber expands again, working fluid is received back from the high pressure manifold into the working chamber. The amount of fluid received back from the high pressure manifold is balanced with the amount which was pumped aiming for no net displacement of working fluid.

This approach also has the advantage of adapting not only the LPV but also the HPV. It is therefore useful where the HPV has been inactive, to precondition the HPV for more reliable subsequent actuation.

Figure 8:
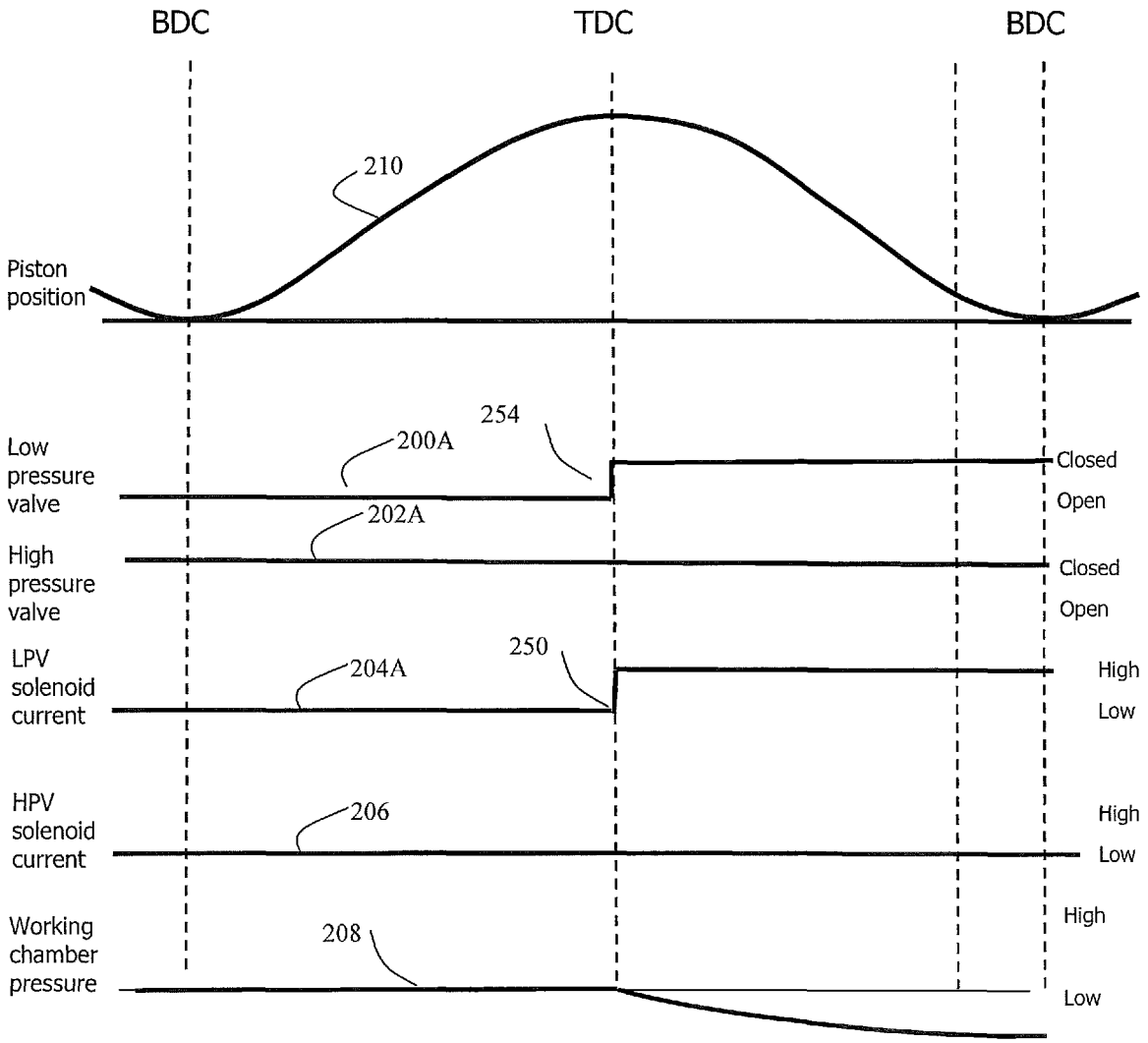
FIG. 8 is a schematic diagram of LPV position, HPV position, working chamber pressure and solenoid currents in a cycle in which the working chamber swaps from one inactive mode to another inactive mode, with movement of the LPV.

In a further embodiment, additional actuator signals may be sent to the LPV actuator of a working chamber which has carried out an inactive cycle to switch the LPV from open to closed, or vice versa. If, as shown in FIG. 8, the LPV was previously open and the working chamber was carrying out an inactive cycle in which working fluid was received from the low pressure manifold and vented to the low pressure manifold with no net displacement, the LPV is closed and for at least the following cycle the working chamber undergoes an "idle cavitation" cycle in which it remains sealed from both the low pressure and high pressure manifold, with no net displacement. Alternatively, if an "idle cavitation" cycle has taken place, the LPV will be opened and for the following cycle the working chamber will carry out an inactive cycle by maintain the LPV in the open position so that the same amount of working fluid is received from and then output to the low pressure manifold. In this approach, the LPV is actuated but the working chamber is effectively switched from one type of inactive cycle to another type of inactive cycle with no displacement to or from the high pressure manifold and therefore no net displacement of working fluid.

In the above examples, the valve inactivity test considers whether a working chamber meets an inactivity test (from which it can be inferred that a valve of the working chamber is inactive).

There are a number of different inactivity tests which can be considered in the step 350 of determining whether to generate additional actuator signals.

1. Additional actuator signals may be generated periodically, for example after a predetermined period of time (e.g. 5 seconds) of non-use of a valve or working chamber. This period of time may be increased after a sufficiently long period of time or number of inactive cycles, in order to conserve power.

2. Additional actuator signals may be generated after a predetermined number of inactive cycles of working chamber volume. The predetermined number of inactive cycles may be increased after a sufficiently long period of time or number of inactive cycles.

3. Additional actuator signals may be generated for the working chambers which have been inactive for the longest period of time or number of cycles of working chamber volume.

4. It may be determined that a working chamber is going to be used for an active cycle which has not undergone an active for cycle for a predetermined period of time or number of cycles of working chamber volume and additional actuator signals may be generated just before the working chamber is used, to carry out an active cycle, typically within a period of 0.1-2.0 times the period of cycles of working chamber volume before valve actuation signals are sent to the LPV of the working chamber to start an active cycle.

5. It may be determined that one or more specific working chambers have a valve which is not meeting a performance criteria (e.g. which is opening too slowly) and the additional actuator signals may be generated more frequently, e.g. on a number of consecutive cycles, for corresponding specific valves.

6. Active actuation signals may in part be generated in response to a measurement by a sensor. For example a measurement of oil film thickness within a valve may be obtained by a thickness sensor (e.g. an ultrasonic thickness gauge). If the oil film thickness meets a criterion (e.g. is less than a predetermined thickness) additional actuator signals are sent to the respective valve.

Accordingly, the invention enables the fluid working machine to perform more reliably than would otherwise be the case.

The invention claimed is:

1. A method of operating a fluid working machine, the machine comprising a rotatable shaft and a plurality of working chambers having working volumes which vary cyclically with rotation of the rotatable shaft, each working chamber having a low pressure valve which regulates the flow of working fluid between the working chamber and a low pressure manifold and a high pressure valve which regulates the flow of working fluid between the working chamber and a high pressure manifold, each low pressure valve being an electronically controlled valve having a valve actuator, the method comprising transmitting primary actuation signals to the actuators, in phased relationship to cycles of working chamber volume, to thereby actively control said electronically controlled low pressure valves to control a net displacement of each working chamber on each cycle of working chamber volume, controlling the net displacement of a group of one or more of the working chambers to follow a target, determining whether a valve inactivity test is met in connection with a low pressure valve of a corresponding working chamber, and responsive to said determination, transmitting one or more additional actuator signals to the actuator of said low pressure valve, wherein said one or more additional actuator signals do not significantly change the net displacement of working fluid by the corresponding working chamber.

2. A method according to claim 1, wherein the valve inactivity test comprises that the corresponding working chamber has not undergone an active cycle for a predetermined period of time, or for a predetermined number of cycles of working chamber volume.

3. A method according to claim 1, wherein the valve inactivity test comprises determining that the low pressure valve has not been actuated for a predetermined period of time, or for a predetermined number of cycles of working chamber volume.

4. A method according to claim 1, wherein the transmission of said one or more additional actuator signals takes place within one cycle of working chamber volume, or within two cycles of working chamber volume or within another predetermined number of cycles of working chamber volume immediately preceding the transmission of actuation signals to the respective valve actuator to select the net displacement of said each working chamber so that the net displacement of the group of one or more of working chambers follows the target.

5. A method according to claim 1, wherein the one or more additional actuator signals do not lead to opening of the respective high pressure valve.

6. A method according to claim 5, wherein said low pressure valve is closed and then opened again during a single expansion stroke of the corresponding working chamber.

7. A method according to claim 6, wherein said low pressure valve is closed and then opened again within a period of time which is less than 25% of the period of a cycle of working chamber volume and said opening again takes place before bottom dead centre.

8. A method according to claim 6, wherein said low pressure valve is closed and then opened again within 72° of phase of the cycles of working chamber volume.

9. A method according to claim 1, wherein, responsive to said determination, the one or more additional actuator signals are transmitted to the actuator of said low pressure valve of the corresponding working chamber, to cause the respective low pressure valve to close and then to open again while the corresponding working chamber remains sealed from the high pressure manifold.

10. A method according to claim 9, wherein said low pressure valve is closed and then opened again within a period of time which is less than 25% of the period of a cycle of working chamber volume and said opening again takes place before bottom dead centre.

11. A method according to claim 1, wherein responsive to said determination, the one or more additional actuator signals are transmitted to the respective valve actuator to urge the low pressure valve open wherein no actuation signal to cause the actuator to urge the low pressure valve open has been transmitted to the respective valve actuator for a period of time which is at least the period of a cycle of working chamber volume.

12. A method according to claim 1, wherein responsive to said determination, the one or more additional actuator signals are transmitted to the actuator of the low pressure valve of the corresponding working chamber, to cause the respective low pressure valve to open and then to close again while the respective working chamber remains sealed from the high pressure manifold.

13. A method according to claim 1, wherein at least one of the working chambers has made no net displacement of working fluid for one or more consecutive cycles, with the respective high pressure valve closed, and with the respective low pressure valve in either state (a) in which the low pressure valve remains open so that the corresponding working chamber remains in fluid communication with the low pressure manifold or state (b) in which the respective low pressure valve remains closed so that the corresponding working chamber remains sealed, and responsive to said determination, closing or opening the respective low pressure valve to swap from state (a) to state (b) or vice versa.

14. A method according to claim 1, wherein, responsive to said determination, while said corresponding working chamber is contracting, the one or more additional actuator signals are transmitted to the actuator of the low pressure valve of the corresponding working chamber, to cause the respective low pressure valve to move from an open position to a closed position to seal the corresponding working chamber and thereby cause the pressure in the corresponding working chamber to increase as the corresponding working chamber further contracts.

15. A method according to claim 13, wherein, once the respective high pressure valve opens, pressurised working fluid from the corresponding working chamber passes out of the corresponding working chamber into the high pressure manifold, through the high pressure valve, while the corresponding working chamber contracts and then substantially the same amount of pressurised working fluid from the high pressure manifold passes into the corresponding working chamber from the high pressure manifold as the corresponding working chamber then expands.

16. A method according to claim 14, wherein, once the respective high pressure valve opens, pressurised working fluid from the corresponding working chamber passes out of the corresponding working chamber into the high pressure manifold, through the high pressure valve, while the corresponding working chamber contracts and then substantially the same amount of pressurised working fluid from the high pressure manifold passes into the corresponding working chamber from the high pressure manifold as the corresponding working chamber then expands.

17. A method according to claim 1, wherein the one or more additional actuator signals do not lead to the net displacement of working fluid because the one or more additional actuator signals do not cause said low pressure valve to move but temporarily adapt the actuator to function more quickly or more reliably in response to a later actuation signal.

18. A fluid working machine comprising:

a rotatable shaft, a plurality of working chambers having working volumes which vary cyclically with rotation of the rotatable shaft, each working chamber having a low pressure valve which regulates the flow of working fluid between the working chamber and a low pressure manifold and a high pressure valve which regulates the flow of working fluid between the working chamber and a high pressure manifold, each low pressure valve being an electronically controlled valve having a valve actuator, and a controller configured to transmit primary actuation signals to the actuators, to thereby actively control said electronically controlled low pressure valves in phased relationship to cycles of working chamber volume control a net displacement of each working chamber, control the net displacement of the working chambers to follow a target, determine whether a valve inactivity test is met in connection with a low pressure valve of a corresponding working chamber, and responsive to said determination, transmit one or more additional actuator signals to the actuator of said low pressure valve, wherein said one or more additional actuator signals do not significantly change the net displacement of working fluid by the corresponding working chamber.

19. A fluid working machine according to claim 18, wherein the one or more additional actuator signals do not lead to opening of the respective high pressure valve.

20. A fluid working machine according to claim 18, wherein said low pressure valve is closed and then opened again during a single expansion stroke of the corresponding working chamber.

* * * * *